US005170612A

United States Patent [19]

Sumino

[11] Patent Number: 5,170,612

[45] Date of Patent: Dec. 15, 1992

[54] PACKING APPARATUS

[75] Inventor: Kousaku Sumino, Kokubunjimachi, Japan

[73] Assignee: Strapack Kabushiki Kaisha, Tokyo, Japan

[21] Appl. No.: 777,779

[22] Filed: Oct. 15, 1991

[30] Foreign Application Priority Data

Dec. 12, 1990 [JP] Japan ..... 2-401548

[51] Int. Cl.[5] ..... B65B 13/10

[52] U.S. Cl. ..... 53/589; 53/588

[58] Field of Search ..... 53/589, 588, 582, 399

[56] References Cited

U.S. PATENT DOCUMENTS 3,233,385 2/1966 Lyon ..... 53/588
4,850,179 7/1989 Takami ..... 53/589
4,850,180 7/1989 Takami ..... 53/589
4,938,009 7/1990 Takami ..... 53/589
4,989,397 2/1991 Tomac et al. ..... 53/588 X

*Primary Examiner*—James F. Coan
*Attorney, Agent, or Firm*—Jordan and Hamburg

[57] ABSTRACT

According to the invention, a band is led to a tip of a guide rod provided at a tip of a movable arm, the band is pulled out therefrom to a slide table side, the band is stretched by sandwiching a front edge of the band by a tension jaw and a clamping jaw provided on the slide table side, a packing article is moved while pressing the stretched band, the movable arm is rotated to wind the band around the packing article, the band is melt bonded by a heater, and the bonded band is cut out after that by a cutting mechanism.

6 Claims, 19 Drawing Sheets

PACKING APPARATUS

FIELD OF THE INVENTION

The invention relates to a packing apparatus for packing by a band and, more particularly, to a packing apparatus which can wind a band by using an arm.

DESCRIPTION OF THE RELATED ART

According to a packing apparatus by winding a band which has conventionally been known, a band is rove into an arch guide and a packing article is positioned in the arch guide. The band rove in the arch guide is removed while pulling out, thereby winding the band around the packing article located in the arch guide.

In such a conventional apparatus, the packing article must be located in the arch guide, so that a large packing article which cannot be put in the arch guide cannot be packed.

When the band is rove into the arch guide, the band is pushed into the arch guide. However, when the strength of the band is weak like a thin band, it is bent upon pushing into the arch guide, so that what is called a nipping occurs. When such a nipping occurs, the band is choked in the arch guide and a state in which the band cannot be supplied is obtained.

Further, the arch guide must be constructed in a manner such that the band is not removed when it is supplied and that the band can be easily removed when the band is fastened. To satisfy such conditions, the structure becomes complicated and troublesome such that the band is deviated from the arch guide when the band is supplied.

Moreover, to make the operation to supply the band to the arch guide smooth, the band wrapped around a core is not directly pulled out but the band pulled out of the core must be retained in a pool box or the like. For this purpose, the pool box must be specially provided.

SUMMARY OF THE INVENTION

It is an object of the invention to provide a packing apparatus which can smoothly pack without using an arch guide.

The invention comprises: a frame formed by a plurality of supporting plates; a rotatable movable arm provided for the frame; a guide rod provided for the movable arm so as to be perpendicular thereto; a guide roller provided at a tip of the guide rod; a sandwiching mechanism to sandwich the band led out of the guide roller; a slide table for leading a packing article toward a band located between the sandwiching mechanism and the guide roller; a left pressing member and a middle pressing member for pressing the band which has been led to the back surface of the slide table by the movable arm; a heater for melt bonding the band pressed by the pressing members; a cutting mechanism to cut the melt bonded band; and a control mechanism to control an operation timing of each of the above component elements, wherein the invention is characterized in that each of the slide table, left pressing member, middle pressing member, adhering mechanism, and cutting mechanism can be moved away from a band supply locus.

When the movable arm is rotated in the above construction, the band led out from the guide roller provided for the guide rod at the tip of the movable arm is wound around the packing article. The wound band is adhered by the adhering mechanism and, thereafter, it is cut by the cutting mechanism.

According to the packing apparatus of the invention, therefore, the arch guide as in the prior art doesn't need to be used. Thus, a large packing article which cannot be put into the arch guide can be also packed and a nipping or the like doesn't occur. The trouble due to the supply of the band to the arch guide doesn't occur as well.

DETAILED DESCRIPTION OF THE PREFERRED EMBODIMENT

Figure 1:
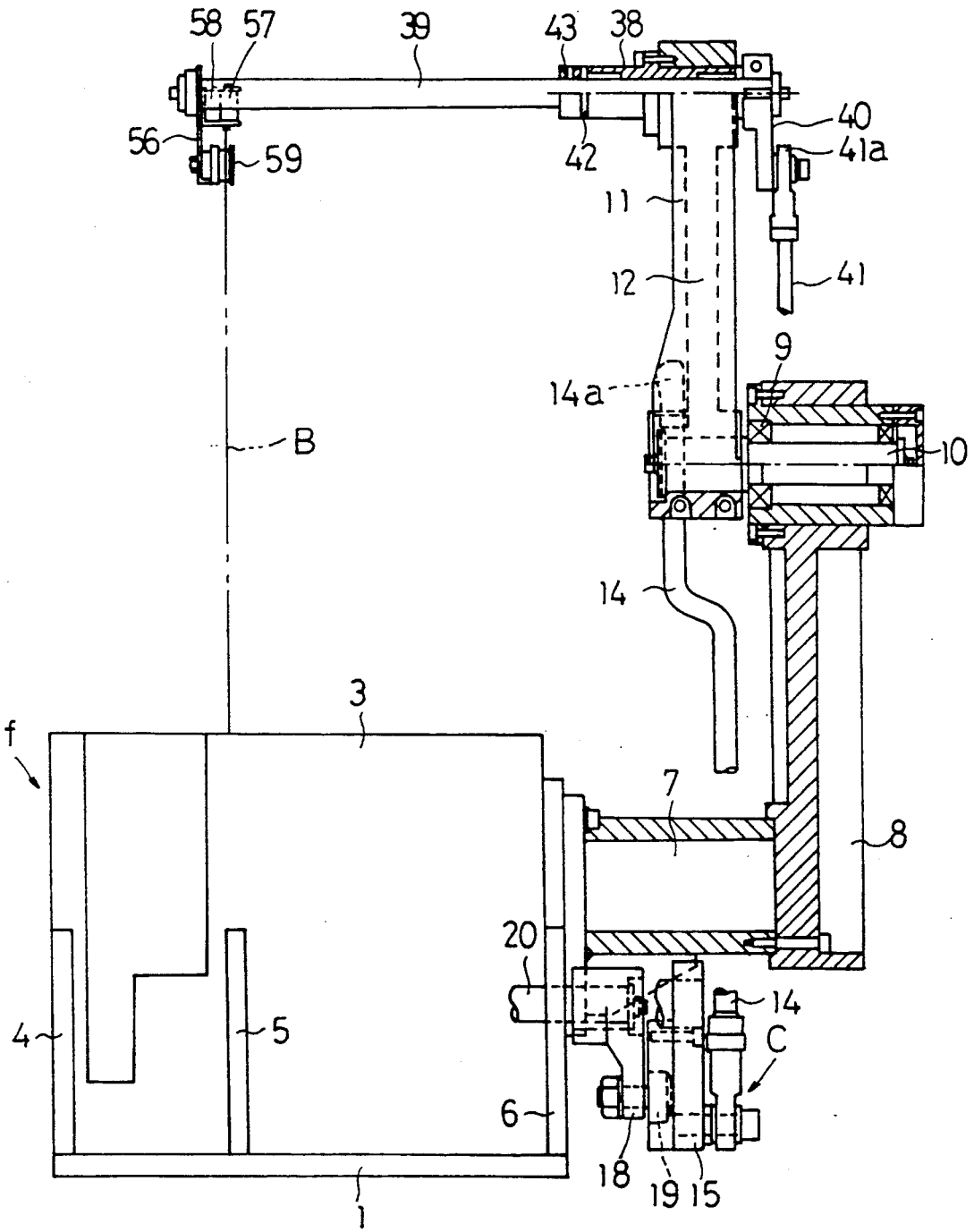
FIG. 1 is a side elevational view showing a structure of a movable arm and a guide rod.
Figure 2:
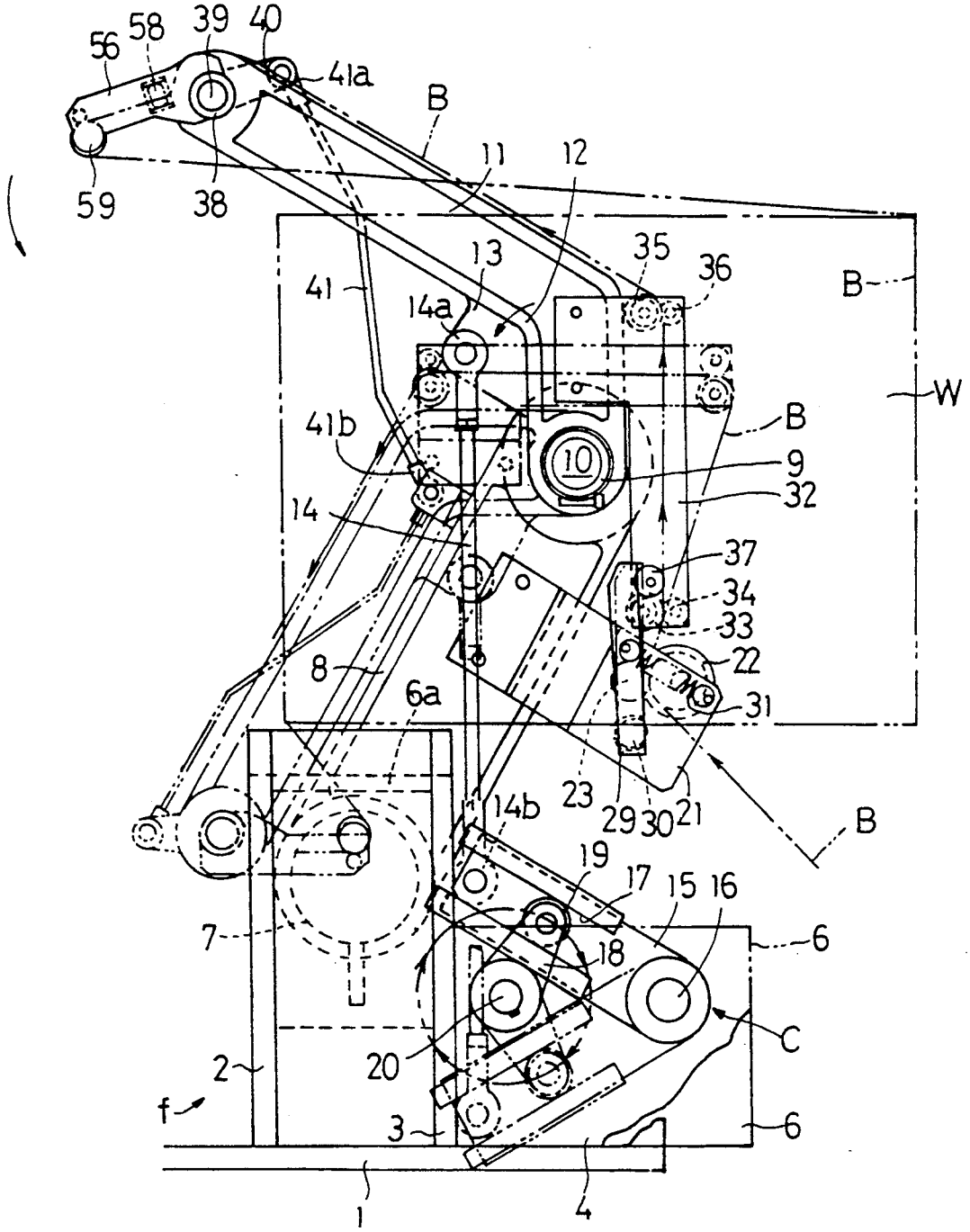
FIG. 2 is a front view showing a rotating mechanism of the movable arm.

An embodiment shown in the diagrams will be described hereinbelow. A frame f in the embodiment comprises a bottom plate 1 and five supporting plates 2 to 6 as shown in FIGS. 1 and 2. That is, a pair of supporting plates 2 and 3 are vertically mounted in parallel on the bottom plate 1. The other three supporting plates 4 to 6 are vertically fixed to the supporting plate 3 on the outside of the supporting plate 3. As shown by reference numeral **6*a* in FIG. 2, a part of only the supporting plate 6 on the outermost side in FIG. 1 is transversed between the side surfaces of the supporting plates 2 and 3**.

A supporting pipe 7 is fixed on the outside of the supporting plate **6*a*. A supporting arm 8 is fixed to a tip of the supporting pipe 7. As will be also obviously understood from FIGS. 1 and 2, the supporting arm 8 is slightly obliquely and vertically mounted in the upper portion and rotatably supports a supporting shaft 10 by a bearing 9 attached to an upper edge of the supporting arm 8**.

As shown in FIG. 1, the supporting shaft 10 is projected to the inside of the supporting arm 8, that is, to the side of the frame f and a movable arm 11 is fixed to a projecting portion of supporting shaft 10. The movable arm 11, therefore, can rotate the supporting shaft 10. As shown in FIG. 2, such a movable arm 11 forms a bending portion 12 at a position which is slightly away from the supporting shaft 10. When the movable arm 11 is at a position shown by a solid line in FIG. 2, the tip of the movable arm 11 is located slightly outside an extension line of the supporting plate 2.

The bending portion 12 has a bracket 13. One end 14*a* of a coupling rod 14 is relatively rotatably attached to the bracket 13. The other end 14*b* of the coupling rod 14 is relatively rotatably attached to the tip of a first crank arm 15 which forms part of a crank mechanism c. The first crank arm 15 is rotatably attached to a shaft 16 attached to the supporting plate 6. A guide groove 17 is formed on the surface on the side opposite to the side where the other end 14*b* of the rod 14 is attached. A roller 19 attached to a tip of a second crank arm 18 which also forms part of crank mechanism c is inserted into the guide groove 17. A base end of the second crank arm 18 is fixed to a cam shaft 20. Therefore, when the second crank arm 18 rotates clockwise in FIG. 2 together with the cam shaft 20, the first crank arm 15 pivots from the position shown by the solid line in FIG. 2 which a top dead point the position shown by the broken line in FIG. 2 which is a bottom dead point.

When the first crank arm 15 swings as mentioned above, the coupling rod 14 is pulled downward in association with the swing of the arm 15, so that the movable arm 11 also rotates counterclockwise in FIG. 2, from the position shown by the solid line in FIG. 2 which is to the top dead point to the position shown by the broken line in FIG. 2 which is the bottom dead point.

Figure 3:
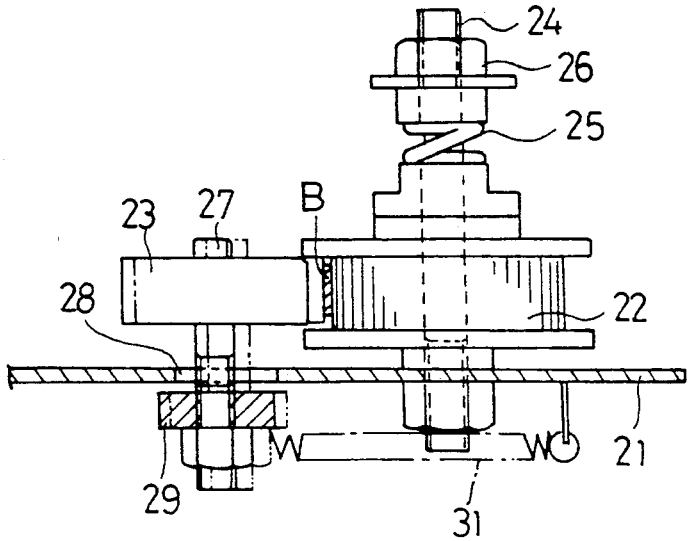
FIG. 3 is a partial enlarged diagram showing the relation between a friction roller attached to the movable arm and a pressure contact roller.

A bracket 21 is fixed to the supporting arm 8. As shown in FIG. 2, the bracket 21 is projected to the side opposite to the bending direction of the movable arm 11. As shown in FIG. 3, a friction roller 22 and a pressure contact roller 23 are provided in association with the bracket 21. A band B for packing is rove between the rollers 22 and 23.

An adjusting spring 25 is attached to a shaft 24 to support the friction roller 22 on bracket 21. By adjusting the spring force of the adjusting spring 25 by a nut 26, the rotational resistance of the friction roller 22 can be adjusted. That is, when the nut 26 is loosened maximally, the friction roller 22 can freely rotate. When the nut 26 is fastened maximally, the friction roller 22 can rotate only by the application of a fairly large force. To increase the frictional force of the friction roller 22 to the band B, a knurled surface is provided on the roller surface.

The pressure contact roller 23 is rotatably supported on a shaft 27. As shown in FIG. 3, the shaft 27 is projected to the opposite side of bracket 21 from an elongated hole 28 formed in the bracket 21 and the projecting portion of shaft 27 is attached to a rotational member 29. The lower side of the rotational member 29 is rotatably supported one a shaft 30 shown in FIG. 2 and is coupled with the bracket 21 through a spring 31. Therefore, a force in the direction of the frictional roller 22 is applied to the pressure contact roller 23 by the action of the spring 31.

As shown in FIG. 2, a bracket 32 is also fixed to the bending portion 12 of the movable arm 11 on the side opposite to the bracket 13. The bracket 32 is set to be almost vertical when the movable arm 11 is at the top dead point position shown by the solid line in FIG. 2. A pair of guide rollers 33 and 34 and another pair of guide rollers 35 and 36 are respectively provided for both end portions. Each pair of guide rollers are held with an opposite interval enough to enable the packing band B to pass between each pair of guide rollers.

The lower guide rollers 33 and 34 face the friction roller 22 and pressure contact roller 23 when the movable arm 11 is at the top dead point position as shown by the solid line. The band B which has passed both of the rollers 22 and 23 is directly led to the guide rollers 33 and 34.

A roller member 37 is provided on the side of bracket 32 opposite to the side where the guide rollers 33 and 34 are provided. When the movable arm 11 is at the top dead point position as shown by the solid line, the roller member 37 comes into contact with the rotational member 29 and moves the rotational member 29 against the spring 31, thereby weakening the pressure contacting force between the friction roller 22 and the pressure contact roller 23. That is, when the movable arm 11 is at the top dead point position, the packing work is at the initial stage, so that it is important to allow the band B to smoothly pass in the above state. Therefore, at the initial stage, the rotational member 29 is moved backward against the spring 31, thereby allowing the band B to smoothly pass. However, when the movable arm 11 only slightly rotates counterclockwise in FIG. 2 from the top dead point position, the roller member 37 moves away from the rotational member 29. Thus, the pressure contact roller 23 comes into pressure contact with the friction roller 22 by the operation of the spring 31.

When the rotational resistance of the friction roller 22 increases in such a state, the band B can be pulled out only by pulling the band B by a large force, so that looseness of the band B in a region ahead of the friction roller 22 can be prevented in correspondence to the necessity of such a large force.

As shown in FIG. 1, a bearing 38 is fixed to the tip of the movable arm 11 and a guide rod 39 is rotatably supported by the bearing 38. The guide rod 39 supported as mentioned above is perpendicular to the movable arm 11 and a base end of the guide rod 39 is projected to the outside of the movable arm 11. As will be obviously understood from FIGS. 1 and 2 as well, a rotational member 40 is fixed to the projecting end of the guide rod 39. One end 41*a* of a rod 41 is relatively rotatably attached to the tip of the rotational member 40. The other end 41*b* of the rod 41 is relatively rotatably attached to the supporting arm 8 as shown in FIG. 2. Therefore, when the movable arm 11 moves from the top dead point as shown by the solid line in FIG. 2 to the bottom dead point as shown by the broken line, the guide rod 39 rotates counterclockwise in FIG. 2 together with the rotational member 40.

Figure 5:
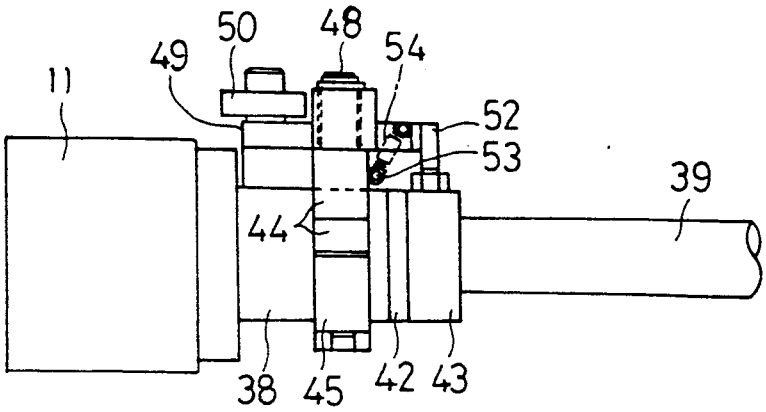
FIG. 5 is a plan view of the guide rod.

Further, as shown in FIGS. 1 and 5, a slide member 42 is rotatably fitted onto the guide rod 39 and a ring member 43 is fixed to the guide rod 39 adjacent to the slide member 42. In such a state, a front edge surface of the bearing 38, slide member 42, and ring member 43 come into contact with each other.

When the guide rod 39 rotates, accordingly, the ring member 43 rotates integratedly with the guide rod 39, and the bearing 38 and the ring member 43 relatively rotate.

Figure 4:
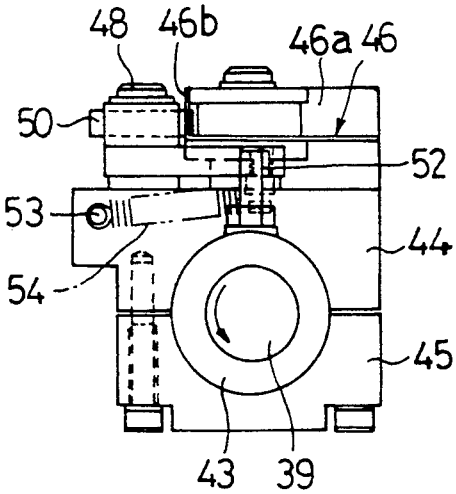
FIG. 4 is a front view of the guide rod.

As shown in FIG. 4, an attaching member 44 is fixed to the bearing 38 as mentioned above. The attaching member 44 sandwiches the bearing 38 together with a stop member 45.

Figure 6:
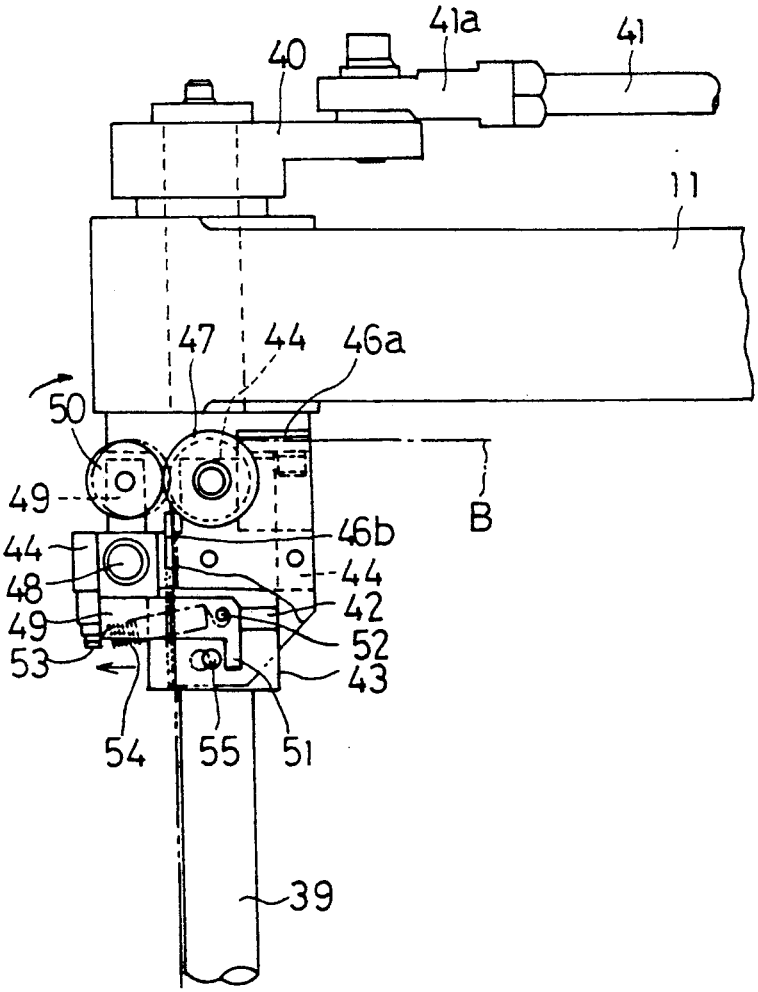
FIG. 6 is a side elevational view of the guide rod.

A guide plate 46 is fixed to the attaching member 44. The guide plate 46 has a first standing member 46*a* which is in parallel with the movable arm 11 and a second standing member 46*b* which is in parallel with the guide rod 39 as shown in FIG. 6. A guide roller 47 is provided in the corner portion where the first and second standing members 46*a* and 46*b* end.

A shaft 48 is vertically mounted on the attaching member 44. As shown in FIG. 6, an operating member 49 whose plan shape is set to a right angle is rotatably attached to the shaft 48. A pressure contact roller 50 is rotatably attached to one end of the operating member 49 and a hanging stop portion 51 is formed at the other end. A spring 54 is attached to a pin 52 fixed near the hanging stop portion 51 and a pin 53 fixed to the side surface of the attaching member 44, thereby applying a force to the operating member 49 so as to rotate the operating member 49 clockwise around the shaft 48 as a center.

Although a pin 55 is fixed to the ring member 43, the pin 55 is located in a rotational locus of the hanging stop portion 51. When the movable arm 11 is at the top dead point position, the pin 55 is held at a position shown in FIG. 6. In such a state, therefore, the pressure contact roller 50 is away from the guide roller 47.

When the movable arm 11 starts to move toward the bottom dead point, the guide rod 39 rotates and the pin 55 moves to a position shown by a broken line in FIG. 6. When the pin 55 moves to such a position, the operating member 49 rotates clockwise in FIG. 6 by the operation of the spring 54, thereby allowing the pressure contact roller 50 to come into pressure contact with the guide roller 47. The functions of the guide roller 47 and pressure contact roller 50 are similar to those of the friction roller 22 and pressure contact roller 23.

As shown in FIGS. 1 and 2, a rotational arm 56 is fixed to the tip of the guide rod 39. Therefore, when the guide rod 39 rotates during a time interval when the movable arm 11 moves from the top dead point to the bottom dead point, the rotational arm 56 also rotates counterclockwise in FIG. 2 in association with the rotation of the guide rod 39. Guide rollers 57, 58, and 59 are provided for the rotational arm 56, thereby allowing the band B led to the tip of the guide rod 39 to be led downward in FIG. 1 by the guide roller 47 while turning in direction.

Figure 7:
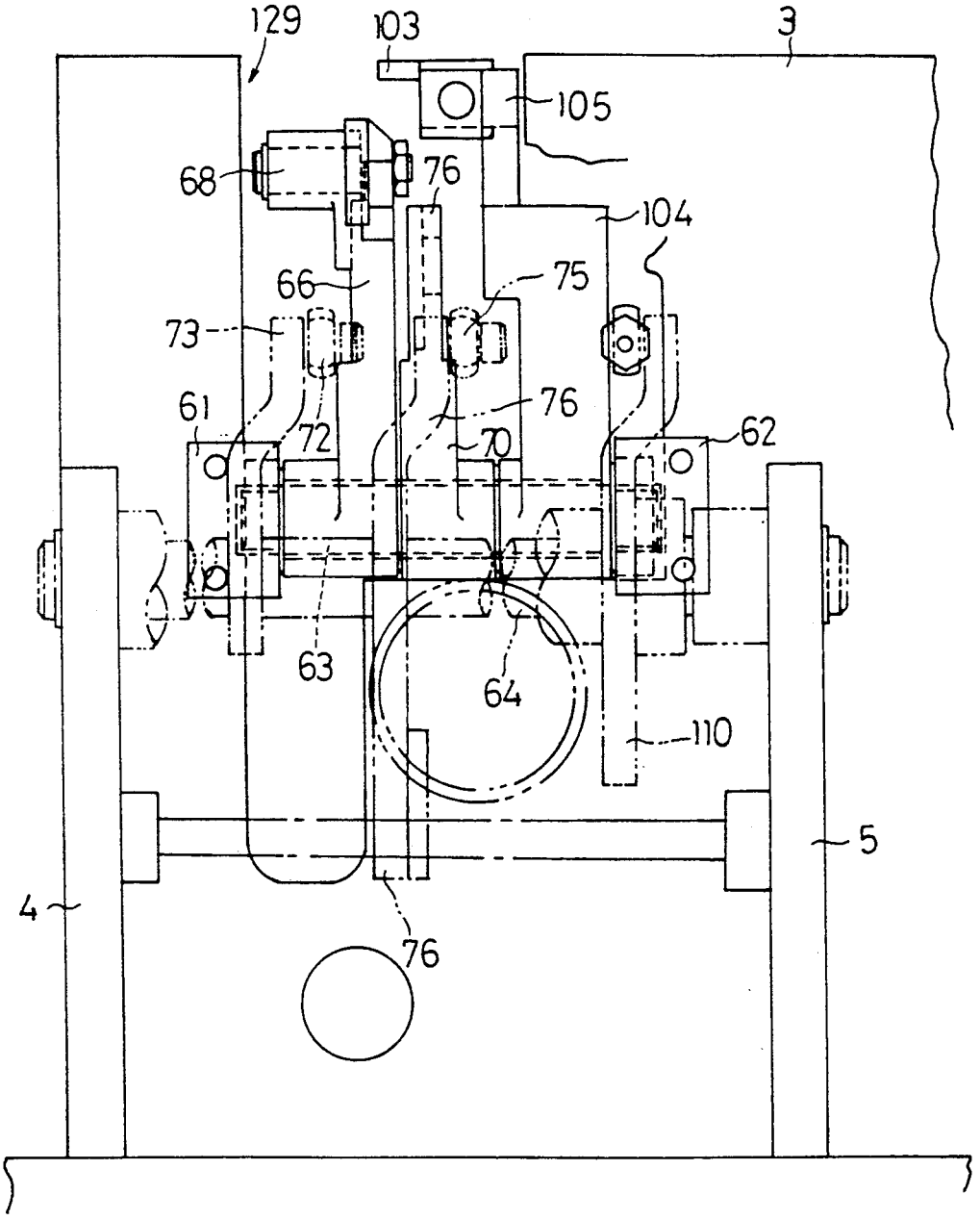
FIG. 7 is a side elevational view showing a mechanism provided between supporting plates.
Figure 8:
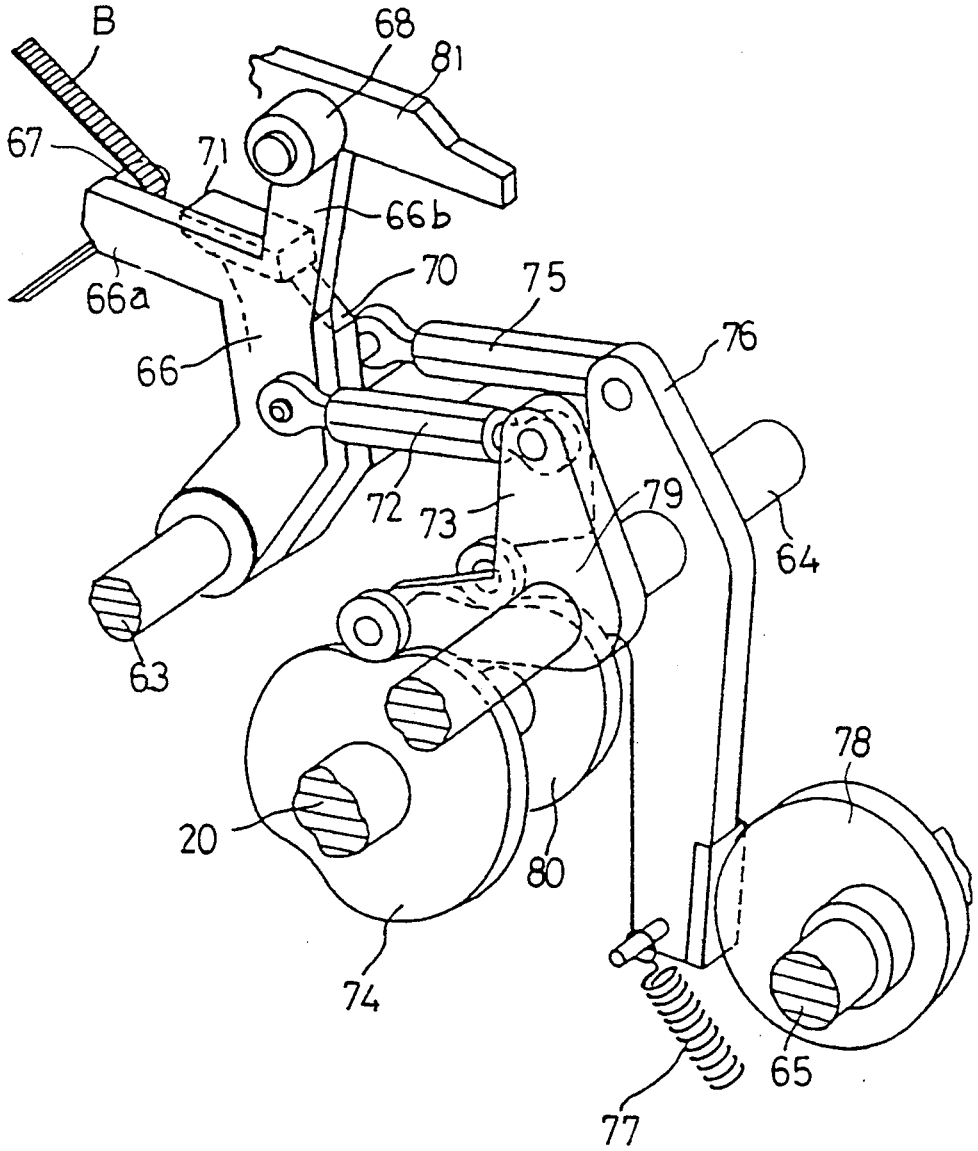
FIG. 8 is a perspective view of a sandwiching mechanism.
Figure 9:
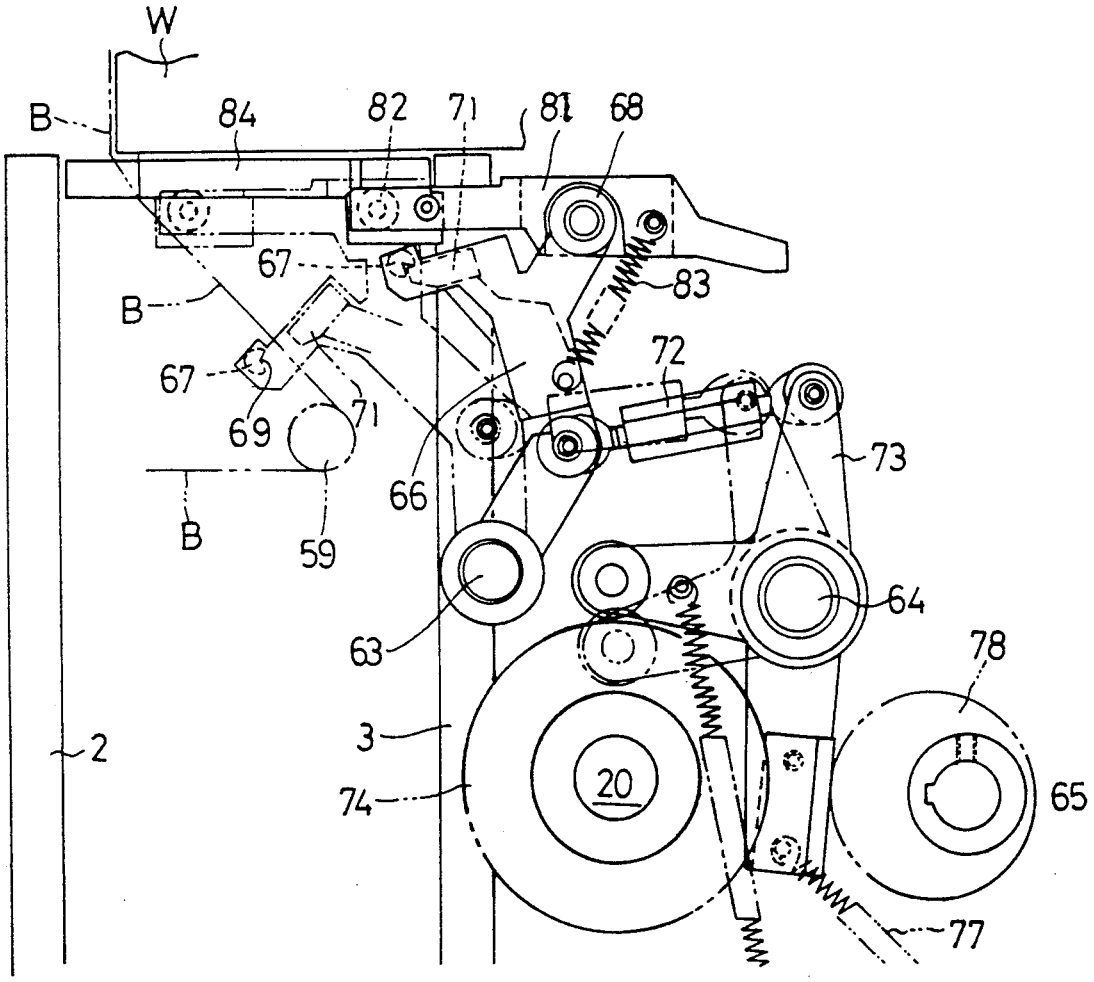
FIG. 9 is a side elevational view of the sandwiching mechanism.

As shown in FIG. 7, a pair of bearings 61 and 62 are provided for the supporting plate 3 corresponding to a portion between the supporting plates 4 and 5. A supporting shaft 63 is supported by the bearings 61 and 62. As shown in FIGS. 8 and 9, a supporting shaft 64 and a cam shaft 65 are supported between the supporting plates 4 and 5. The cam shaft 20 is extended to a position between the supporting plates 4 and 5.

A holding arm 66 is rotatably attached to the supporting shaft 63. A tip of the holding arm 66 is formed like a fork. A tension jaw 67 is provided at a tip of one branch member 66*a* of such a fork-shaped tip and a bearing member 68 is provided for the other branch member 66*b*. The tension jaw 67 is formed with a notched portion 69 as shown in FIG. 9.

Another holding arm 70 is rotatably attached to the supporting shaft 63. The holding arms 70 and 66 are neighboring. A clamping jaw 71 is fixed to the holding arm 70. A tip of the clamping jaw 71 coincides with that of the notched portion 69.

As shown in FIG. 8, one end of a coupling rod 72 is relatively rotatably attached to the holding arm 66. The other end of the coupling rod 72 is relatively rotatably attached to one end of a crank arm 73 mounted on supporting shaft 64. The other end of the crank arm 73 is in contact with a cam 74 fixed to the cam shaft 20.

One end of a coupling rod 75 is relatively rotatably attached to the holding arm 70. The other end of the coupling rod 75 is relatively rotatably attached to a crank arm 76 mounted on supporting shaft 64.

The other end of the crank arm 76 is always in contact with a cam 78 fixed to the cam shaft 65 by the operation of a spring 77. A projection 79 which is in parallel with the other crank arm 73 is formed as part of the crank arm 76. The projection 79 is in contact with a cam 80 fixed to the cam shaft 20.

The tension jaw 67 and clamping jaw 71 mentioned above are held at positions shown by solid lines in FIG. 9 when the movable arm 11 is at the top dead point position. The tip of the clamping jaw 71 coincides with the notched portion 69 formed in the tension jaw 67. As will be obviously understood from FIG. 9 as well, both of the jaws 67 and 71 are set so as to face the portion between both of the supporting plates 2 and 3 from the direction perpendicular to the supporting plates 2 and 3.

A sandwiching mechanism of the invention is constructed by the foregoing tension jaw 67, clamping jaw 71 and, holding arms 66 and 70 to make those jaws operative, and the like.

The front edge of the band B which has been led downward in FIG. 1 from the guide roller 59 at the tip of the guide rod 39 is tightly held by the tension jaw 67 and clamping jaw 71 in a state in which the tip of the band B is slightly extended.

A band guide member 81 is rotatably attached to the bearing member 68 provided on the branch member 66*b* of the holding arm 66. As shown in FIG. 9, a guide roller 82 is provided at a tip of the band guide member 81. A spring 83 is attached between an end on the side opposite to the above tip side and the holding arm 66. Even when the holding arm 66 rotates counterclockwise in FIG. 9, the guide roller 82 at the tip of the holding arm 66 always comes into contact with a lower side of a slide table 84, which will be explained hereinafter.

Figure 10:
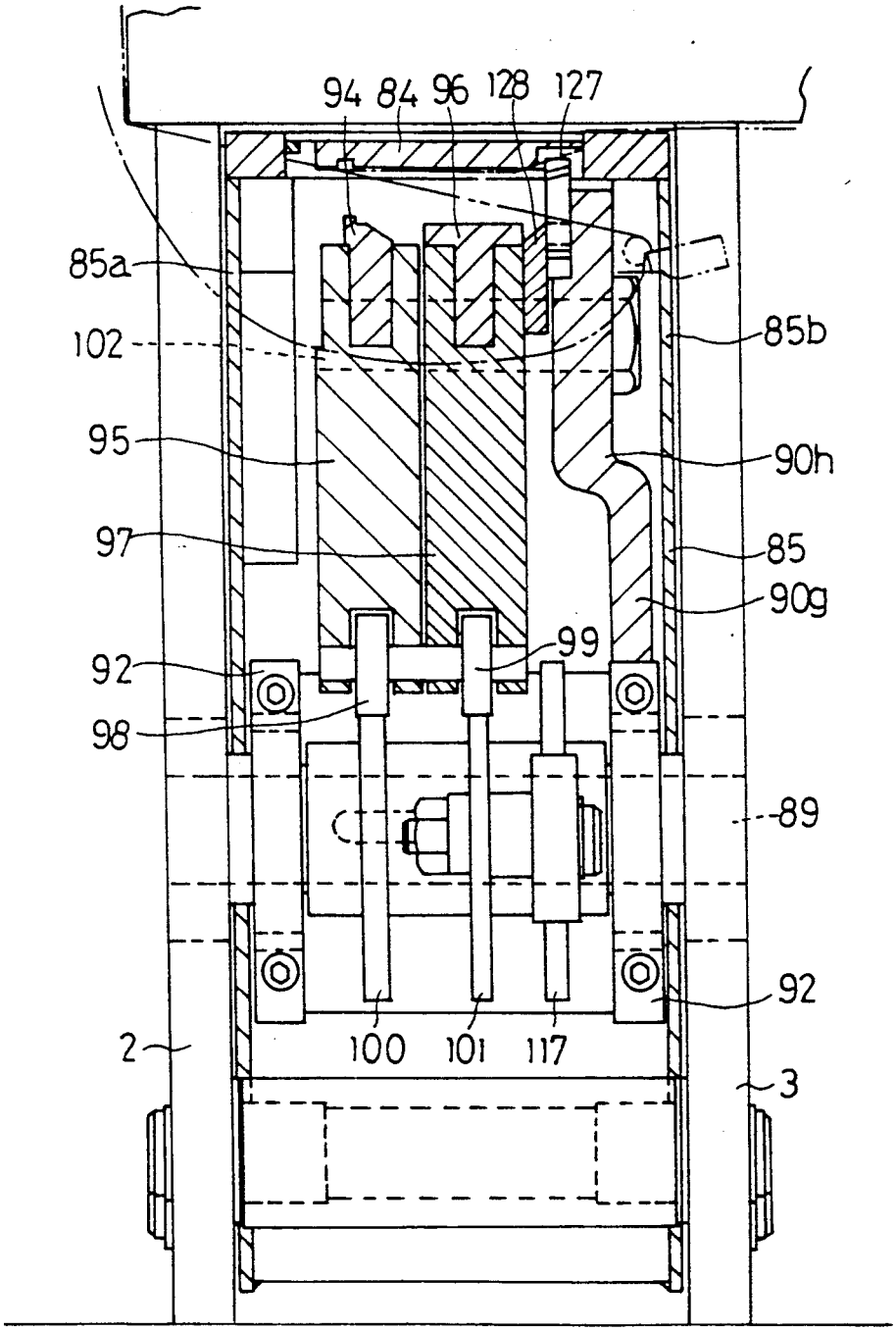
FIG. 10 is a front view of a rotational frame and component elements assembled therein.
Figure 11:
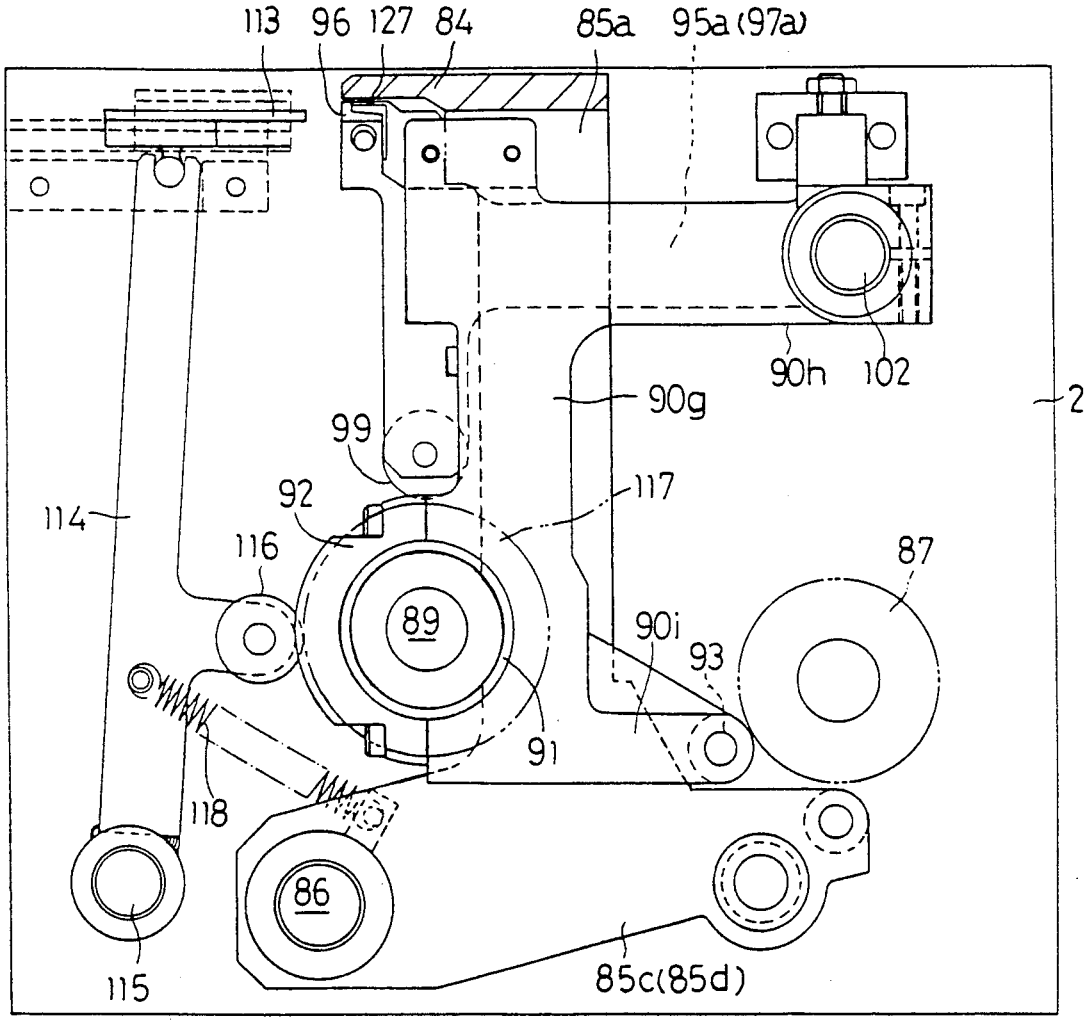
FIG. 11 is a side elevational view of FIG. 10.
Figure 12:
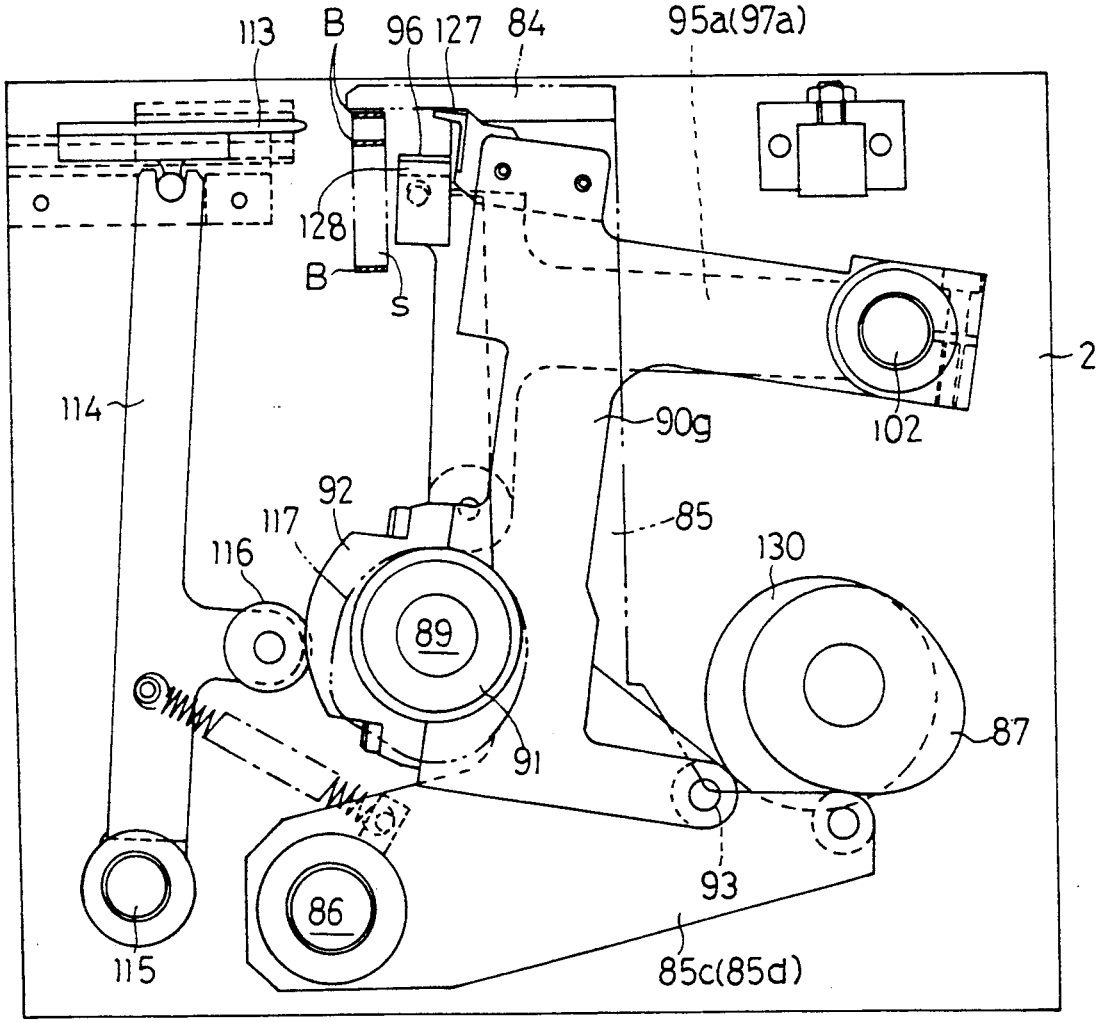
FIG. 12 is a side elevational view showing a state in which the component elements in FIG. 11 are moved out of a band locus.

As shown in FIGS. 10 to 12, a swing frame 85 is provided between the supporting plates 2 and 3. The slide table 84 is suspended on left and right side plates 85*a* and 85*b* of the swing frame 85. As shown in FIGS. 11 and 12, swing members 85*c* and 85*d* are integrally formed on the lower sides of both of the side plates 85*a* and 85*b*. Tip portions of those swing members are supported on a shaft 86 so that they can freely swing. Rear edge portions of the swing members 85*c* and 85*d* come into contact with a cam 87, thereby allowing the swing 85 to swing around the shaft 86 as a center in dependence on the rotating position of the cam 87.

Figure 13:
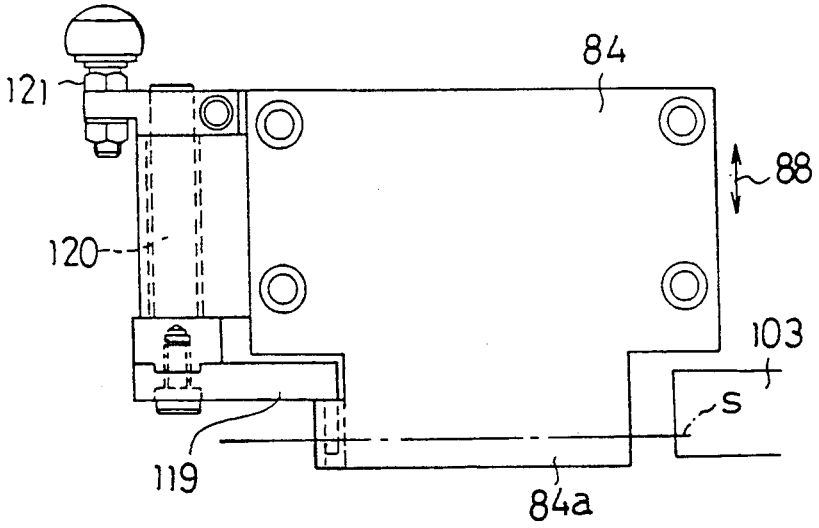
FIG. 13 is a plan view of a slide table.

FIG. 13 shows a plan view of the slide table 84 suspended on the upper edge of the swing frame 85. That is, a convex portion 84*a* is formed on one side of the slide table 84. When the swing frame 85 swings as mentioned above, the slide table 84 reciprocates in the directions shown by arrows 88 in FIG. 13. When the slide table 84 is at a position shown in FIG. 11, the convex portion 84*a* is located in a band supply locus s of the band B. When the slide table 84 rotates clockwise in FIG. 11, the convex portion 84*a* is retreated from the band supply locus s.

Figure 14:
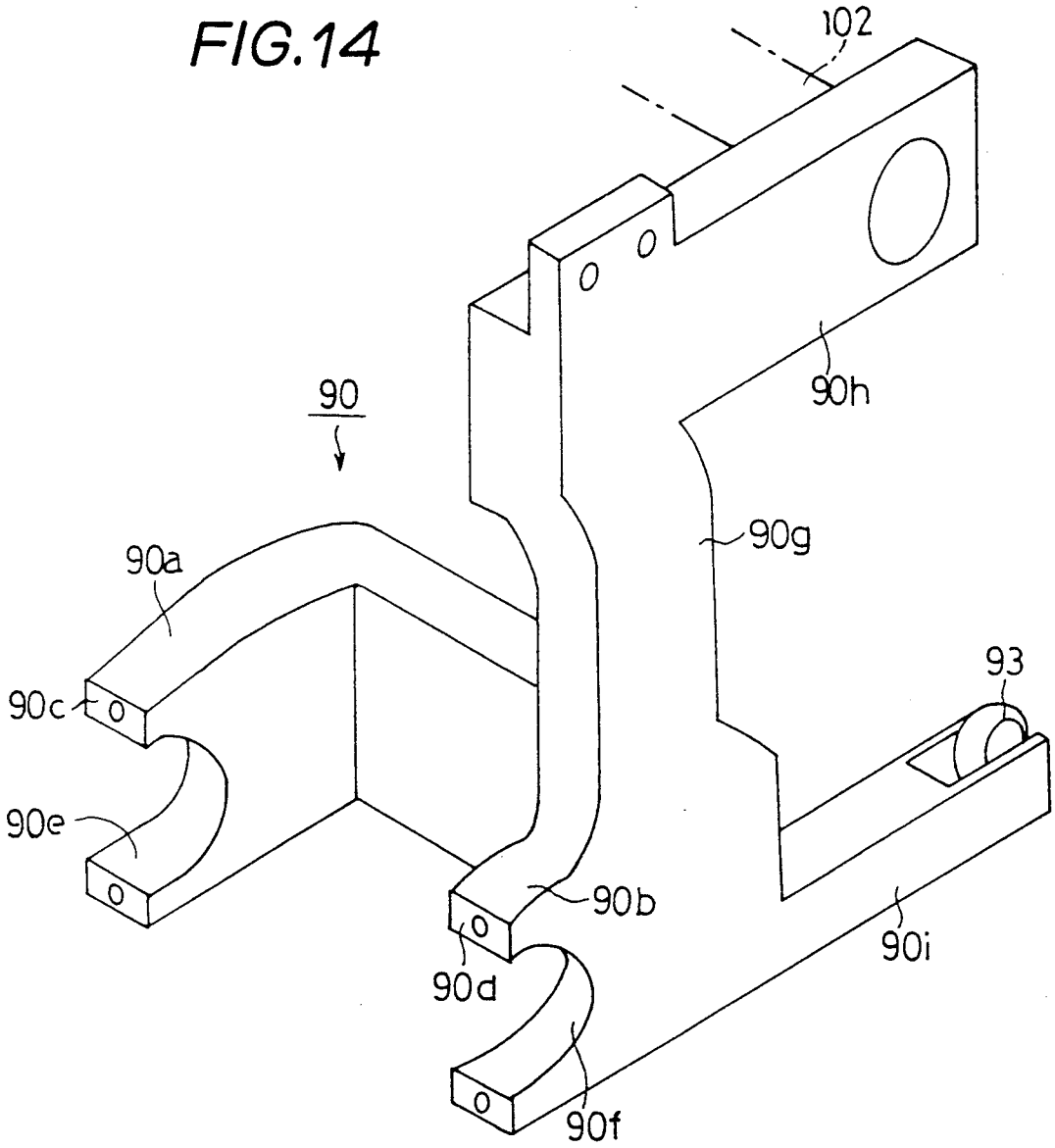
FIG. 14 is a perspective view of a rotational member.

A shaft 89 is suspended in the swing frame 85. A rotational member 90 is rotatably retained on the shaft 89. As shown in FIG. 14, a pair of attaching members 90*a* and 90*b* of the rotational member 90 face each other with a predetermined interval. Concave portions 90*e* and 90*f* into which a bearing 91 is fitted are formed on front surfaces 90*c* and 90*d* of both of the attaching members 90*a* and 90*b*. The bearing 91 is fitted into the shaft 89. A coupling 92 is abutted on the front surfaces 90*c* and 90*d*. The rotational member 90 is supported to the shaft 89 so as to freely swing.

A standing member 90*g* is formed on the side of the attaching member 90*b*. A supporting member 90*h* which is projected to the side opposite to the attaching members 90*a* and 90*b* is formed in the upper portion of the standing member 90*g*. Further, a swing member 90*i* is formed in the lower portion of the standing member 90*g*. A roller 93 which comes into contact with a cam 130 shown in FIG. 12 is attached to a tip of the swing member 90*i*.

A holder 95 to hold a left pressing member 94 shown in FIG. 10 and a holder 97 to hold a middle pressing member 96 are attached to the supporting member 90*h*. An attaching structure of the holders 95 and 97 is as follows. That is, as will be also obviously understood from FIGS. 10 to 12, rollers 98 and 99 are provided at lower edges of both of the holders 95 and 97. The rollers 98 and 99 are in contact with cams 100 and 101 fixed to the shaft 89. As will be also obviously understood from FIG. 11, the holders 95 and 97 are formed with rotational members 95*a* and 97*a* similar to the supporting member 90*h* of the rotational member 90. Rear edges of the rotational members 95*a* and 97*a* are rotatably attached to a shaft 102 provided for the supporting member 90*h*.

The holders 95 and 97, therefore, vertically swing around the shaft 102 as a center in accordance with the motions of the cams 100 and 101 and can be retreated from the band supply locus s shown in FIG. 12 in association with the swing of the rotational member 90.

The band B is sandwiched by one side of the convex portion 84*a* of the slide table 84 and a right pressing member 103. The right pressing member 103 and its supporting mechanism are as shown in FIGS. 7 and 15.

That is, a rotational member 104 is provided on the supporting shaft 63 attached to the supporting plate 3. A holder 105 is rotatably attached to the rotational member 104 by a shaft 106. The right pressing member 103 is attached to a tip of the holder 105. A spring 107 shown in FIG. 15 is attached between the holder 105 and the rotational member 104, thereby allowing a spring force of the spring 107 to act as a sandwiching force with respect to the tip of the right pressing member 103 and the convex portion 84*a* of the slide table 84 even after the tip and the convex portion 84*a* come into contact with each other as shown in the diagram. The spring force of the spring 107 can be properly adjusted by rotating a nut 108.

One end of a rod 109 is relatively rotatably attached to the rotational member 104. The other end of the rod 109 is relatively rotatably attached to a tip of a swing member 110. A central portion of the swing member 110 is rotatably attached to the supporting shaft 64. A lower end of the swing member 110 is in contact with a cam 111 fixed to the cam shaft 20. Reference numeral 112 in FIG. 15 denotes a spring, by which the rotational member 104 and swing member 110 are coupled.

Figure 15:
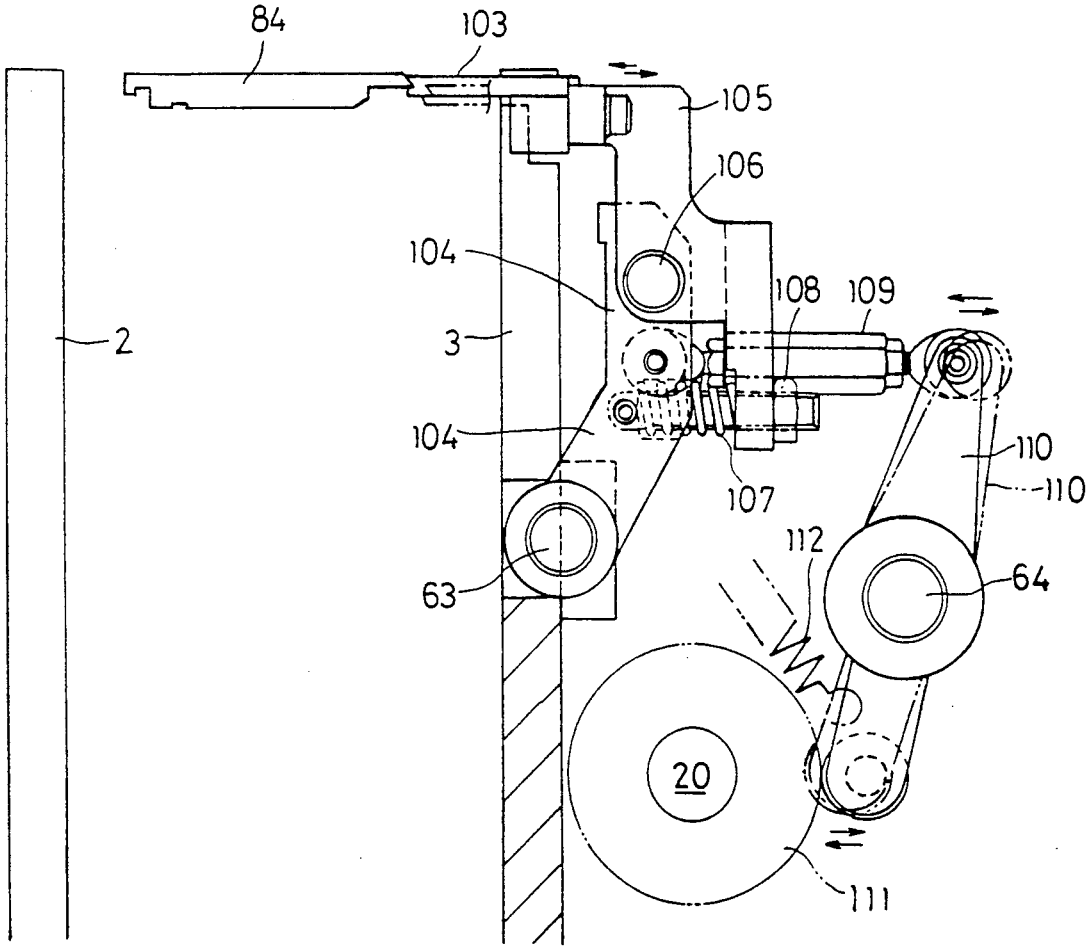
FIG. 15 is a diagram of an operating mechanism of a right pressing member.

The swing member 110, therefore, swings from a position shown by the solid line in FIG. 15 to a position shown by the broken line in association with the rotation of the cam 111. When the swing member 110 moves to the position shown by the broken line, the holder 105 rotates clockwise, thereby removing the right pressing member 103 away from the slide table 84.

Reference numeral 129 in the diagram denotes a notch formed in the supporting plate 3. The notch 129 is provided so as to enable the sandwiching mechanism and the right pressing member 103 to be projected to the inside of the supporting plate 3.

A heater 113 shown in FIGS. 11 and 12 is attached to a tip of a swing arm 114. A base end of the swing arm 114 is rotatably supported by a shaft 115. A roller 116 attached to an almost middle portion of the swing arm 114 is in contact with a cam 117 fixed to the shaft 89. A spring 118 is attached between the swing arm 114 and the swing frame 85, thereby allowing the roller 116 to always come into contact with the cam 117.

The heater 113 attached to the swing arm 114 is projected into the band supply locus s or is retreated therefrom in association with the swing of the swing arm 114.

Figure 16:
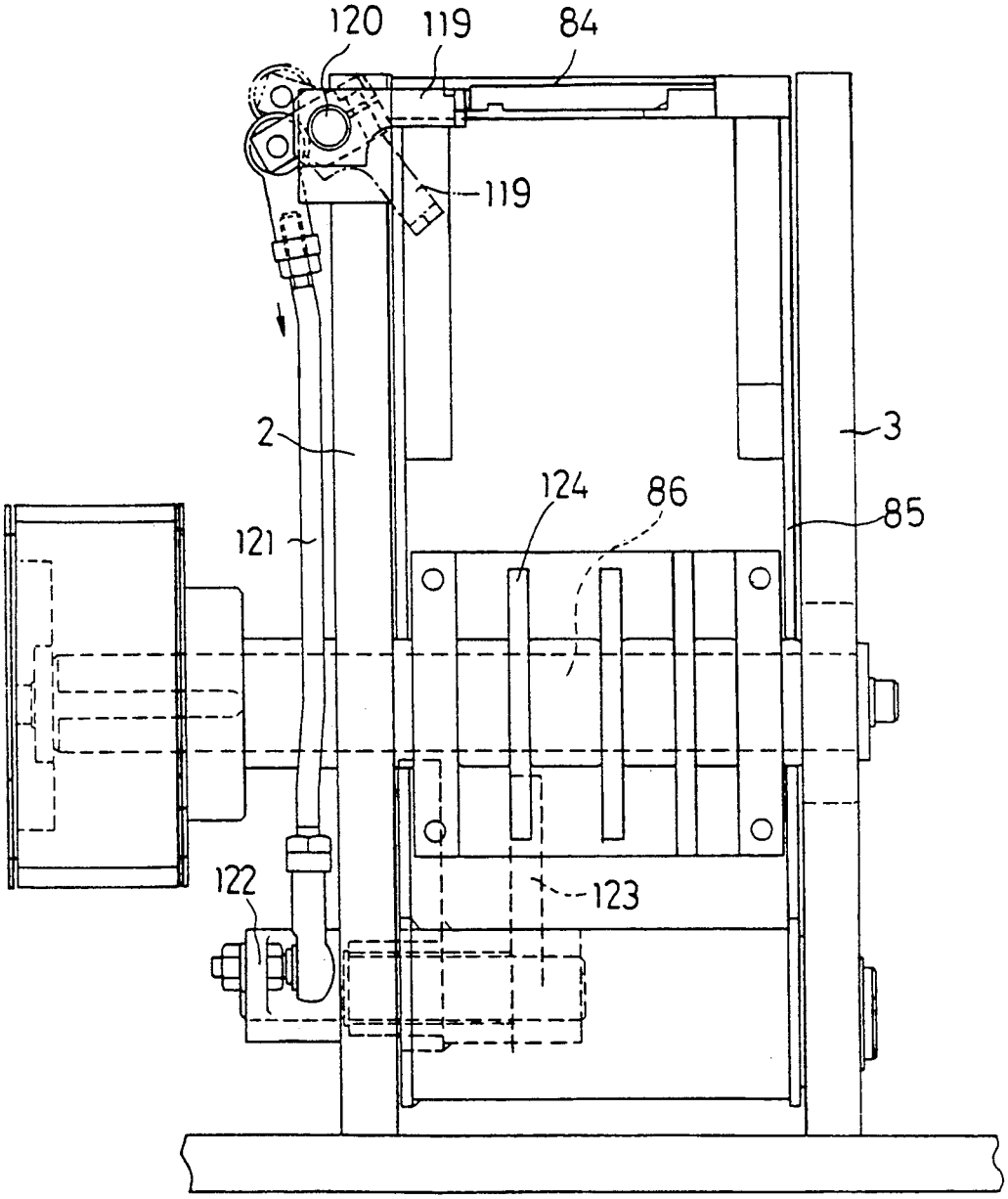
FIG. 16 is a diagram of an operating mechanism of a temporary stopping mechanism.

Further, a temporary stop member 119 shown in FIG. 16 is rotatably attached to a shaft 120 provided on the side of the supporting plate 2. The temporary stop member 119 is coupled with a crank shaft 122 through a rod 121. The crank shaft 122 is projected to the inside of the supporting plate 2. A lever 123 formed to the projecting portion is arranged so as to face the inside of the rotational locus of a cam 124 to which the shaft 86 is fixed.

Each time the lever 123 collides with the cam, the crank shaft 122 rotates, thereby reciprocating the rod 121. When the rod 121 reciprocates, the temporary stop member 119 also rotates.

The actual packing operation will now be described with reference to FIGS. 17 to 24.

Figure 17:
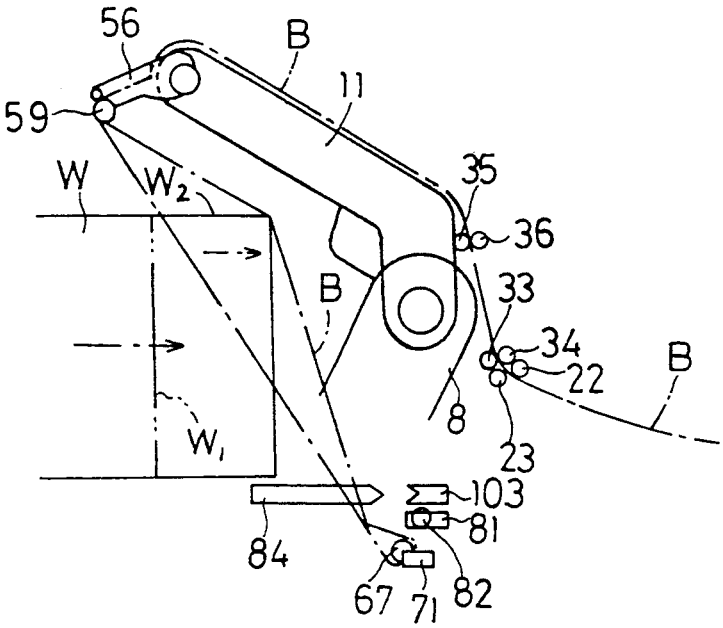
FIGS. 17 to 24 are explanatory diagrams showing operating states.

First, the movable arm 11 is held at the top dead point position shown by the solid line in FIG. 2. The band B stocked in a predetermined portion is pulled out. As shown in FIG. 17, the band B is subsequently led to the guide roller 59 at the tip of the guide rod 39 via the friction roller 22 and guide roller 47. The direction is changed around guide roller 59 and the band is pulled out to the frame f side as shown in FIG. 1 and is sandwiched by the tension jaw 67 and the clamping jaw 71 so as to extend a part of the front edge of the band B therepast.

In the above state, the convex portion 84*a* of the slide table 84 is at the position where it is retreated from the band supply locus s shown in FIG. 13. Consequently, even when the band B is pulled out as shown in FIG. 17, the band B doesn't interfere with the slide table 84.

Figure 18:
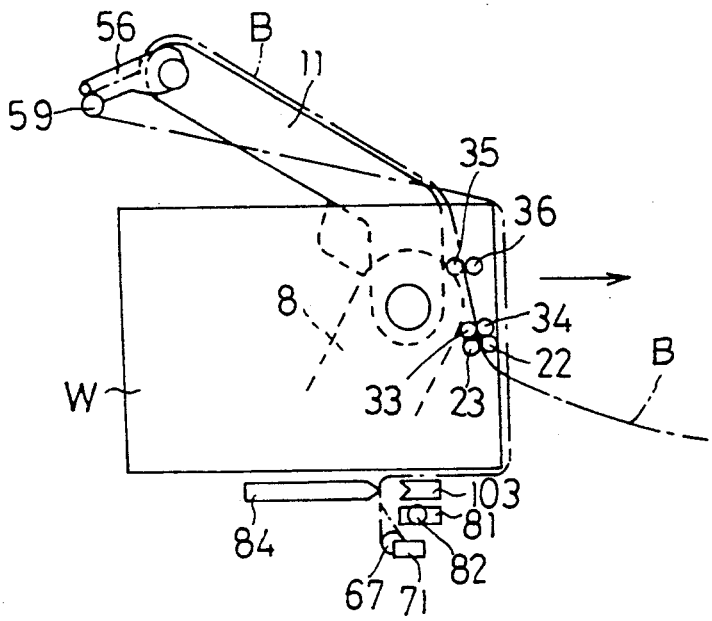

In the state of FIG. 17, when a packing article W is moved from a $W_1$ position to a $W_2$ position, the band B is depressed by the front edge of the packing article W and the convex portion 84*a* of the slide table 84 gradually progresses to the band supply locus s side. When the band B is pushed by the packing article W and completely passes through the front edge portion of the slide table 84, the convex portion 84*a* is projected into the band supply locus s. In such a state, the band B is located between the convex portion 84*a* and the right pressing member 103 as shown in FIG. 18.

Figure 19:
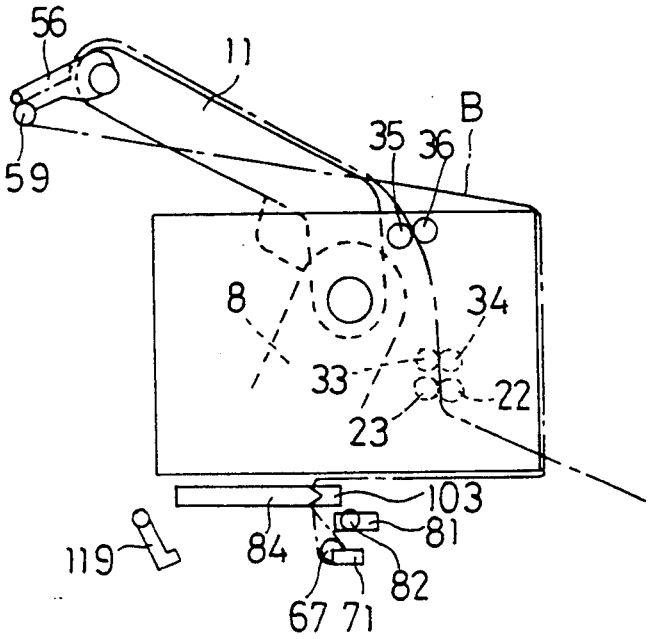

When the band B is located as mentioned above, the swing member 110 now rotates from the broken line position in FIG. 15 to the solid line position due to the operation of the cam 111, thereby allowing the right pressing member 103 to be come into pressure contact with the convex portion 84*a* and tightly sandwiching the band B as shown in FIG. 19.

Although the holding arm 66 starts to rotate in the above state, the adjacent holding arm 70 also starts to rotate at a timing which is slightly delayed. The tension jaw 67 and clamping jaw 71 are away from each other by only the deviation amount of the rotating timings between the holding arms 66 and 70, so that the front edge of the band B which has been sandwiched until now is released.

The front edge of the band B released from both of the jaws 67 and 71 is stretched by the guide roller 82 attached to the band guide member 81 so as to be adhered onto the back side of the convex portion 84*a*.

Figure 20:
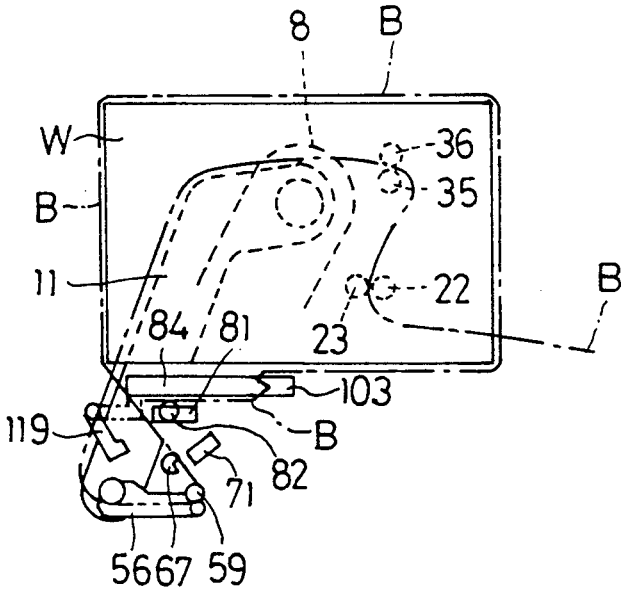

In the above state, the temporary stop member 119 starts to rotate and the front edge of the band B adhered onto the back surface of the convex portion 84*a* is sandwiched together with the convex portion 84*a* as shown in FIG. 20.

As the movable arm 11 rotates to the bottom dead point position, the band B is successively pulled out and wound around the packing article W during this time interval. When the band B is pulled out, a sufficiently large tension is applied to the band B in cooperation with both the frictional force by the friction roller 22 and pressure contact roller 23 and the frictional force by the guide roller 47 and pressure contact roller 50, thereby preventing the band B from being loosened.

During the time interval when the movable arm 11 rotates to the bottom dead point position as mentioned above, the guide rod 39 rotates the rotational arm 56 while rotating. As shown in FIG. 20, therefore, the band B pulled out of the guide roller 59 is further led to the inside. During time interval when the band B is led to the inside, the band B is depressed between the tension jaw 67 and the clamping jaw 71.

Figure 25:
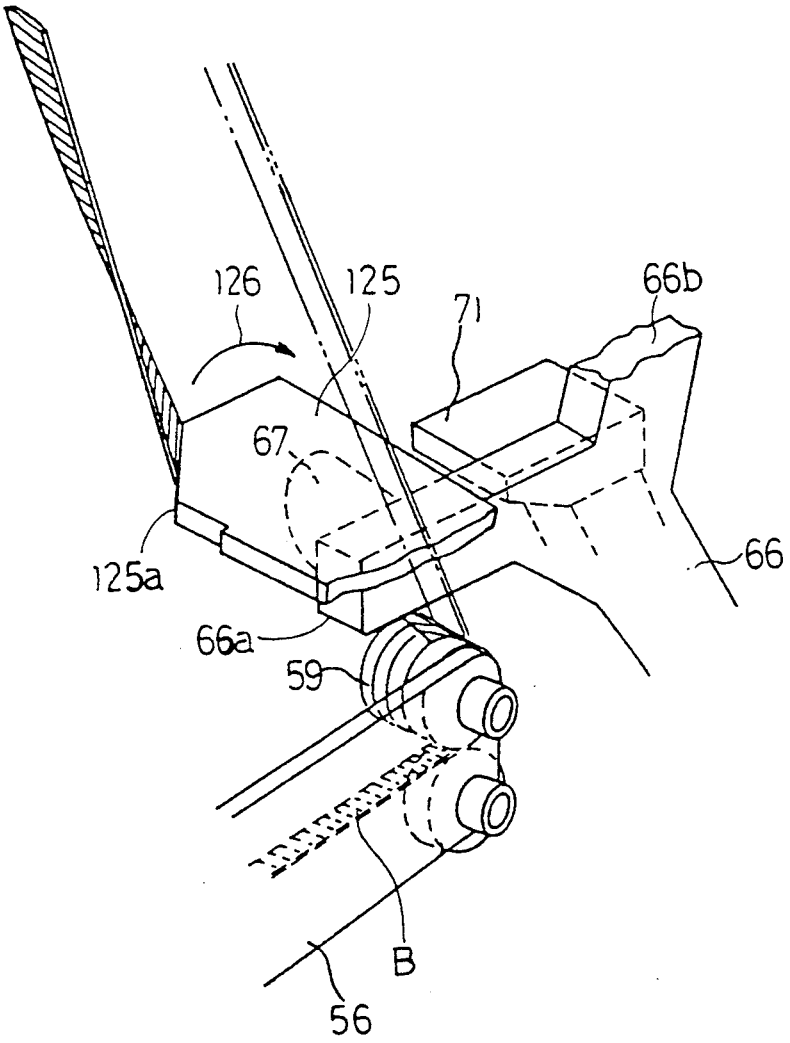
FIG. 25 is a perspective view showing a state in which the band is guided to a sandwiching mechanism.

That is, although a guide plate 125 is fixed to the branch member 66*a* of the holding arm 66 as shown in FIG. 25, the guide plate 125 is located over the tension jaw 67 provided for the branch member 66*a*. The guide plate 125 forms an inclined corner portion 125*a*. The inclined portion 125*a* keeps a positional relation such that it comes into contact with the band B rove between the guide roller 59 and the packing article W. Therefore, when the rotational arm 56 rotates and depresses the band B to the inside, the band B comes into contact with the inclined portion 125*a* and slides in the direction indicated by an arrow 126 in FIG. 25. Due to the movement in the direction of the arrow 126, the band B slides into a space between the tension jaw 67 and the clamping jaw 71.

Figure 21:
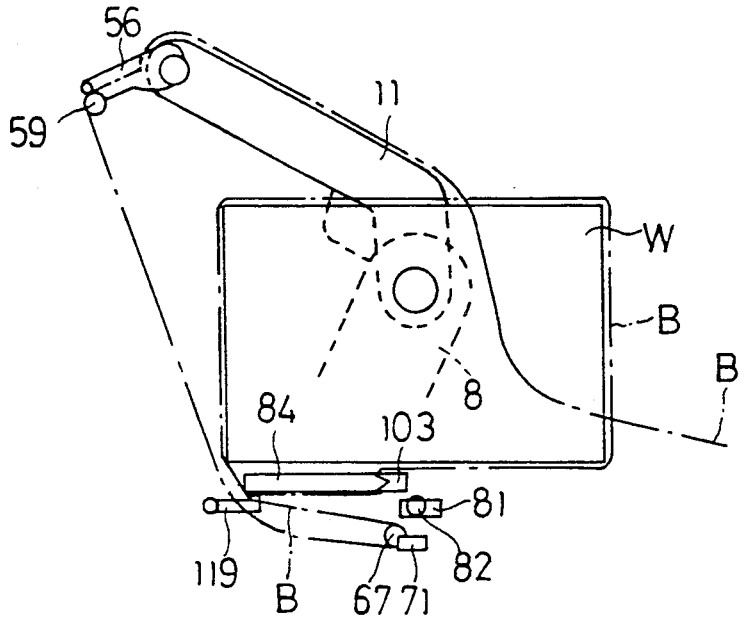

As mentioned above, when the band B is located between both of the jaws 67 and 71, the band B is now again finally sandwiched by both of the jaws 67 and 71 while narrowing the space between them as shown in FIG. 21. The holding arms 66 and 70 are returned to the original position while sandwiching the band B. During this process, the band B wound around the packing article W is fastened.

Figure 22:
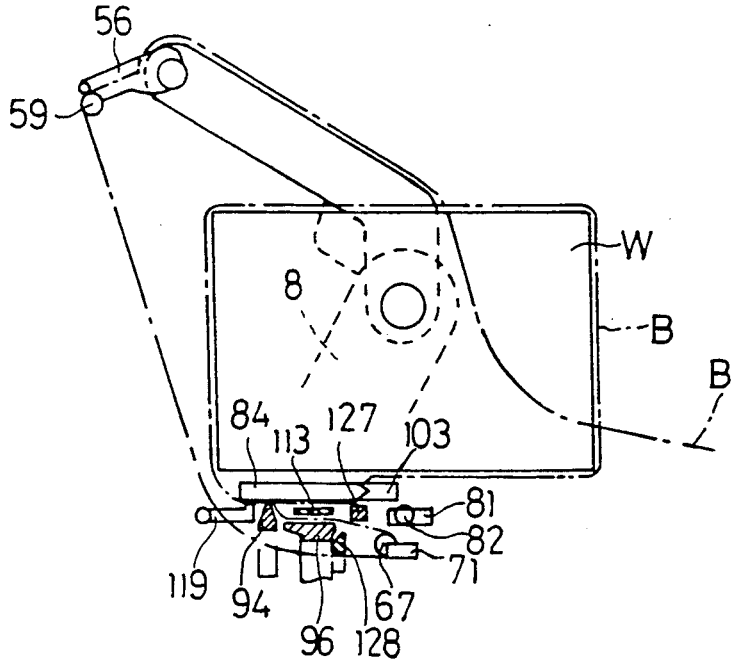
Figure 23:
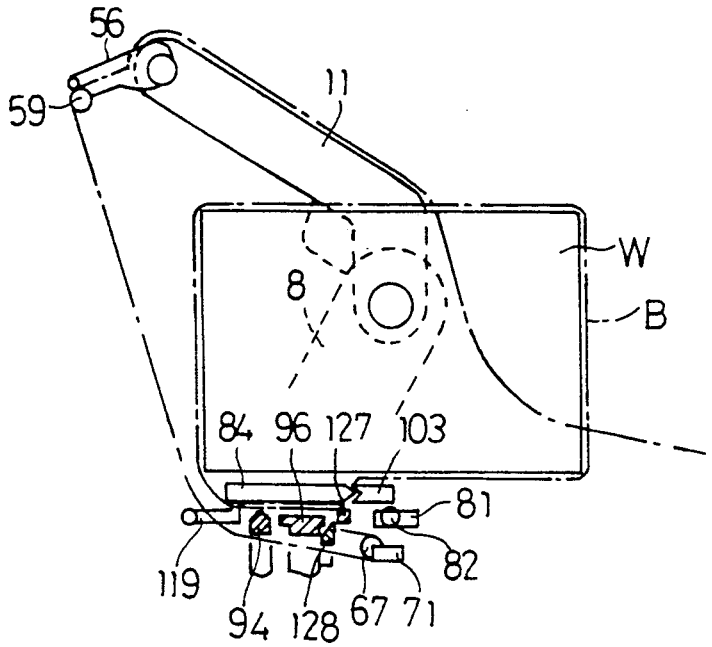

Upon completion of the fastening of the band B, the rotational member 90 rotates as shown in FIG. 22, thereby allowing the left pressing member 94 and middle pressing member 96 and an upper blade 127 attached to the rotational member 90 to face the inside of the band supply locus s. Moreover, the left pressing member 94 moves upward and the front edge of the band B pressed by the temporary stop member 119 and the middle portion of the band B pulled into by both of the jaws 67 and 71 are sandwiched by the slide table 84 and the left pressing member 94.

In the above state, the heater 113 enters the region between the band adhered to the slide table 84 and the band located between the left pressing member 94 and the tension jaw 67 and heats both of them, thereby melting the band B. After the band B is melted, the heater 113 retreats from the band supply locus s.

After the heater 113 retreats, the middle pressing member 96 moves up, thereby strictly adhering the melted band. A lower blade 128 is provided for the side surface of the middle pressing member 96. The band B is cut out by the lower and upper blades 128 and 127. A cutting mechanism of the invention is constructed by the upper and lower blades 127 and 128.

When the band is cut out as mentioned above, the rotational member 90 rotates, thereby moving the left pressing member 94, middle pressing member 96, and upper blade 127 provided for the rotational member 90 away from the supply locus of the band B. The right pressing member 103 is also removed away from the slide table 84. After the right pressing member 103 is removed, the slide table 84 is also deviated out of the band supply locus s. A series of packing works are completed.

Figure 24:
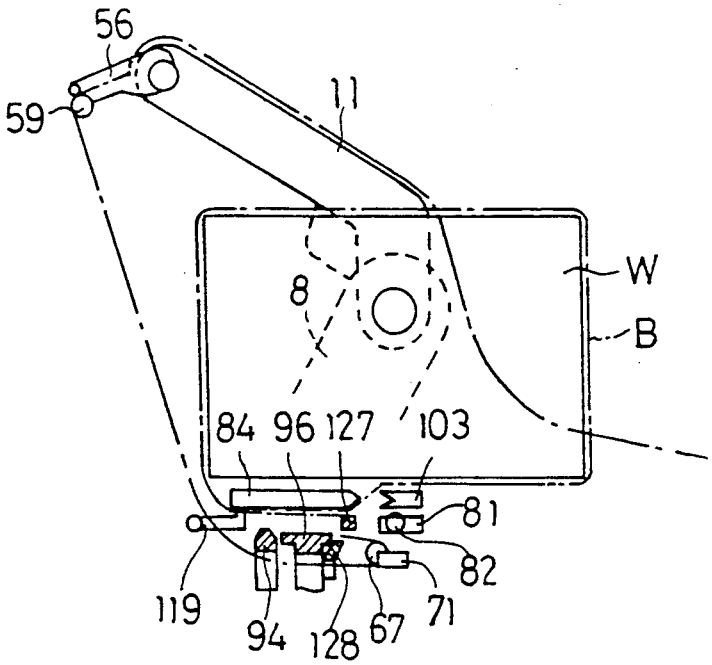

After completion of the series of packing works, the movable arm 11 is also returned to the original position as shown in FIG. 24. The front edge of the band B is sandwiched by the tension jaw 67 and the clamping jaw 71 and the apparatus waits for the next packing work.

In the above embodiment, the operation timings of the component elements are maintained by using the cam mechanism. An electronic control mechanism, however, can be also obviously used in place of the cam mechanism.

What is claimed is:

1. A packing apparatus comprising:

a frame constructed of a plurality of supporting plates;

a movable arm rotatably mounted on the frame for movement along a path in an arc of approximately 180° from a first position away from a packing article to a second position toward the packing article and along said path from the second position back to said first position;

a guide rod mounted perpendicularly to the movable arm;

guide roller means for guiding a band, said guide roller means being provided at a tip of the guide rod and being movable to a position adjacent the packing article when the movable arm is moved to the second position;

sandwiching means for sandwiching the band which is adjacent the packing article and which has been led out from the guide roller means when said movable arm is moved from said second position to said first position along said path;

slide table means for leading a packing article toward a portion of the band located between the sandwiching means and the guide roller means;

pressing member means for pressing the band which is led to a back surface of the slide table means by the movable arm;

heater means for melting the band pressed by said pressing member means;

adhering member means for adhering the melted band by pressure to an opposite free end thereof;

cutting means for cutting off the adhered melted band; and control means for controlling operation timings of said movable arm, said guide rod, said guide roller means, said sandwiching means, said slide table means, said pressing member means, said heater means, said adhering member means and said cutting means; and each of the slide table means, pressing member means, heater means, adhering member means, and cutting means being movable toward and away from a supply locus of said band.

2. An apparatus according to claim 1, wherein said sandwiching means includes a first freely pivotable holding arm, a second holding arm, a tension jaw attached to said first freely pivotable holding arm and a clamping jaw attached to said second holding arm, wherein by deviating swinging timings of both of said holding arms, the tension jaw and the clamping jaw are moved into and out of contact with each other.

3. An apparatus according to claim 1, wherein said control means includes a plurality of cams.

4. An apparatus according to claim 1, wherein said cutting means comprises an upper blade and a lower blade and the lower blade is fixed to the adhering member means.

5. An apparatus according to claim 1, further including a second movable arm rotatably mounted to the tip of the guide rod, and said guide roller means includes a first guide roller mounted to a free end of said second movable arm.

6. An apparatus according to claim 5, wherein said guide roller means further includes second and third guide rollers mounted on the second movable arm for creating a nip between which the band can move.

* * * * *